US005173656A

United States Patent [19]

Seevinck et al.

[11] Patent Number: 5,173,656

[45] Date of Patent: Dec. 22, 1992

[54] REFERENCE GENERATOR FOR GENERATING A REFERENCE VOLTAGE AND A REFERENCE CURRENT

[75] Inventors: Evert Seevinck, Eindhoven, Netherlands; Philip D. Costello, Sunnyvale, Calif.

[73] Assignee: U.S. Philips Corp., New York, N.Y.

[21] Appl. No.: 690,446

[22] Filed: Apr. 23, 1991

[30] Foreign Application Priority Data

Apr. 27, 1990 [NL] Netherlands ..... 9001018

[51] Int. Cl.[5] ..... G05F 3/16; G05F 3/20

[52] U.S. Cl. ..... 323/314; 323/316; 323/907; 323/315; 307/296.1; 307/296.8

[58] Field of Search ..... 323/313, 314, 315, 316, 323/907; 307/296.1, 296.2, 296.6, 296.8

[56] References Cited

U.S. PATENT DOCUMENTS

| | | | |
|---|---|---|---|
| 4,454,467 | 6/1984 | Sakaguchi | 323/313 |
| 4,587,478 | 5/1986 | Kasperkovitz et al. | 323/316 |
| 4,978,904 | 12/1990 | Fitzpatrick et al. | 323/313 |
| 5,047,706 | 9/1991 | Ishibashi | 323/315 |
| 5,087,891 | 2/1992 | Cytera | 330/288 |

*Primary Examiner*—Steven L. Stephan
*Assistant Examiner*—Ben Davidson
*Attorney, Agent, or Firm*—Steven R. Biren

[57] ABSTRACT

A reference generator includes a first, a second and an additional third current mirror for generating both a reference output current and a reference output voltage. As the reference output voltage only depends on the gate-source voltages of transistors which are fed with a constant current, the reference output voltage has a constant value and is substantially independent of the ambient temperature.

8 Claims, 1 Drawing Sheet

REFERENCE GENERATOR FOR GENERATING A REFERENCE VOLTAGE AND A REFERENCE CURRENT

BACKGROUND OF THE INVENTION

The invention relates to a reference generator for generating a reference output current at a current output terminal, comprising a first and a second current mirror and a resistive element, an output circuit of the first current mirror being coupled to an input circuit of the second current mirror, and an output circuit of the second current mirror being coupled to the input circuit of the first current mirror, the output circuit of the second current mirror being coupled to a power supply terminal via a resistive element.

Such a reference generator is known from the book "Analysis and Design of Analog Integrated Circuits" by Gray and Meyer, 2nd edition, page 283, more specifically Fig. 4.25(a). The reference generator described therein is suitable for generating a reference output current IOUT, which is highly independent of the operating temperature of the reference generator.

SUMMARY OF THE INVENTION

It is inter alia an object of the invention to provide a reference generator which, in addition to supplying a reference output current, is also suitable for supplying an output reference voltage which is also highly independent of the operating temperature of the generator.

To that end, a reference generator according to the invention is characterized in that the reference generator also includes a third current mirror, an output circuit of which is coupled to the output circuit of the first current mirror, an input circuit of this third current mirror being connected to a voltage output terminal for supplying a reference output voltage. By simply adding only a few components (one current mirror), a reference generator is thus provided which is capable of supplying both a reference output current and a reference output voltage, which renders such a reference generator suitable for a wider field of application.

An embodiment of a reference generator of the invention is characterized in that the output circuit of the third current mirror is arranged between the output circuit and input circuit of the first and second current mirror, respectively, or between the output circuit and input circuit of the second and first current mirror, respectively. As a result thereof, the input currents and output currents of the third current mirror are obtained from the first and second current mirror, so that the third current mirror does *not* use extra current originating from the power supply voltage. This results in a lower current consumption of the reference generator of the invention.

BRIEF DESCRIPTION OF THE DRAWING

The invention will now be described in greater detail with reference to an embodiment shown in the accompanying drawing, in which.

DESCRIPTION OF THE PREFERRED EMBODIMENT

Figure 1:
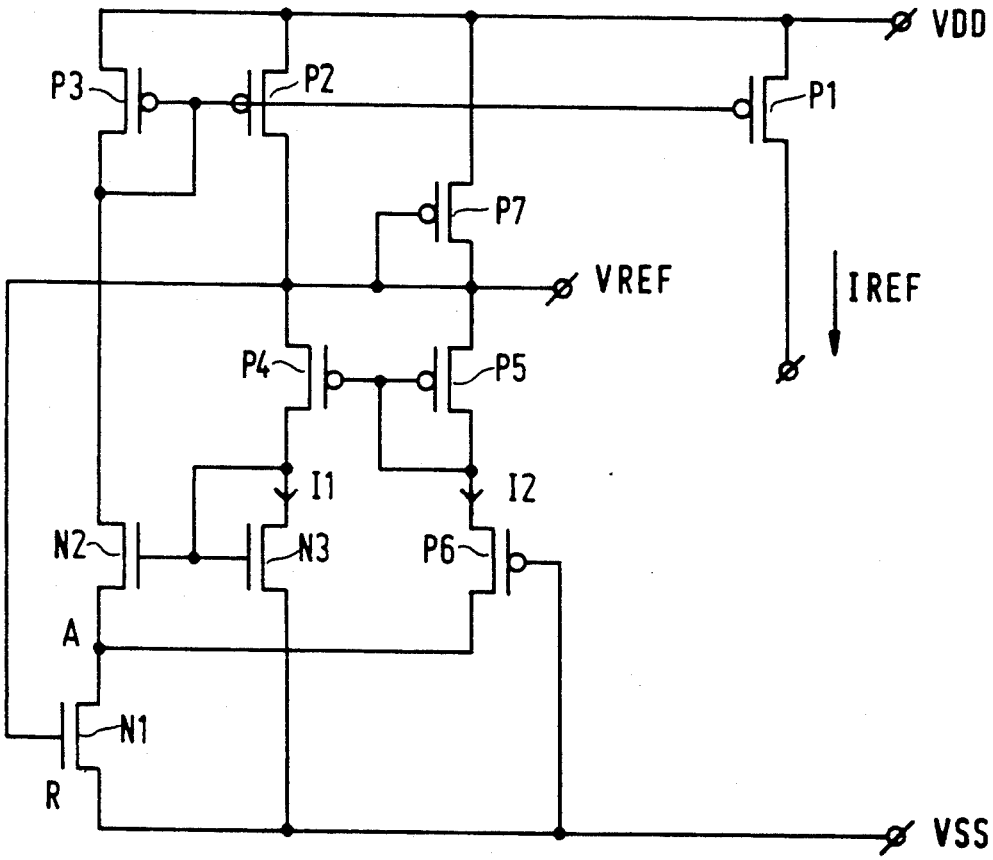
FIG. 1 shows a preferred embodiment of a reference generator in accordance with the invention.

FIG. 1 shows a preferred embodiment of a reference generator of the invention. The generator comprises NMOS-transistors N1, N2 and N3 and PMOS-transistors P1 to P7. The sources of PMOS-transistors P1, P2, P3 and P7 are connected to power supply terminal VDD. The gates of transistors P1, P2 and P3 are interconnected and connected to the drain of transistor P3. The drain of transistor P1 is connected to a current output terminal for the supply of a reference output current IREF. The drain of transistor P2 is connected to the source of PMOS-transistors P4 and P5, to the gate and drain of transistor P7 and to the output voltage terminal VREF. The gates of transistors P4 and P5 are interconnected and connected to the drain of transistor P5 and to the source of PMOS-transistor P6. The gates of NMOS-transistors N2 and N3 are interconnected and connected to the drain of transistor N3 and to the drain of transistor P4. The source of transistor N2 is connected to a junction point A and to the drains of NMOS-transistor N1 and PMOS-transistor P6. The sources of NMOS-transistors N1 and N3 and the gate of transistor P6 are connected to power supply terminal VSS. The drain of transistor N3 is connected to the drain of transistor P4 and the drain of NMOS-transistor N2 is connected to the drain of transistor P3. The gate of transistor N1 is connected to voltage output terminal VREF.

The reference generator shown in FIG. 1 operates as follows. Transistors P2 and P3 form a first current mirror, transistors N2 and N3 form a second current mirror and transistors P4 and P5 form a third current mirror. NMOS-transistor N1 acts as a resistive element. The first and second current mirrors and transistor N1 form a reference generator known in itself for generating a reference output current IREF, see page 283 of the said reference (Gray and Meyer) and also pages 238 and 239 of the reference (Gray and Meyer) ("Widlar Current Source") mentioned above. Therein it is described that a reference generator known per se having a first and a second current mirror and a resistive element produce a reference output current which depends only to a slight extent on temperature. In accordance with the present invention, a third current mirror is also included, which in FIG. 1 is constituted by PMOS-transistors P4 and P5. A current I2 whose value is proportional to the current I1 through transistor P4 in response to the current mirror action of transistors P4 and P5, flows through the main current path of transistors P5 and P6. Since current I1 has a constant value (see Gray and Meyer), current I2 consequently also has a constant value. It will be obvious that the ratio between currents I2 and I1 depends on the relative geometrical ratios of transistors P5 and P4. Since current I2 has a constant value, the gate-source voltages of transistors P5 and P6 are also substantially constant. As the voltage VREF at the voltage output terminal is equal to the sum of the gate-source voltages of transistors P5 and P6, the voltage VREF consequently also has a constant value. Since transistors P4 and P5 derive their current directly from transistor P2, they do not cause an additional current consumption. The gate-source voltages of transistors P5 and P6 are substantially independent of the ambient temperature, as the gate-source voltages of transistors P5 and P6 are formed by the sum of a threshold having a negative temperature coefficient and a gate-source drive voltage having a positive temperature coefficient, so that these two effects substantially cancel each other. Namely, the drive voltages of transistors P5 and P6 appear to be proportional to the voltage across junction point A. If the NMOS-transistors N2 and N3 are operative in what is commonly called the "weak inversion" region, the voltage across junction point A appears to be positively dependent on the ambient temperature, that is to say that when the ambient temperature rises, the voltage across junction point A will increase (the so-called PTAT effect, Positive To Absolute Temperature).

Preferably, the drain of transistor P6 is connected in accordance with the invention to junction point A (as is shown in FIG. 1), causing the current I2 to flow through transistor N1. This has the advantage, that for generating a given desired voltage at junction point A, a lower resistance value of transistor N1 can be chosen to have still the desired voltage across junction point A available. Reducing the resistance value of transistor N1 implies, that the width/length ratio (W/L) of transistor N1 may be choser to be greater. When the width (W) of transistor N1 remains the same, this means that the length (L) may be proportionally smaller. Consequently, less chip surface area is required to realize transistor N1.

Also, in accordance with the invention, the gate electrode of transistor N1 is preferably connected to the voltage output terminal. As a result thereof, the gate of transistor N1 receives a constant voltage VREF, which is independent of any variation in the supply voltage VDD. Consequently, transistor N1 has a resistance value which is independent of variations in the supply voltage VVD.

Preferably, the resistive element is a field-effect transistor, since the gate-source voltage of a field-effect transistor, when fully conducting, can be many times higher than the base-emitter voltage of a fully conducting bipolar transistor (1 $V_{BE}$). Consequently, the voltage VREF can then assume a higher value than only 1 $V_{BE}$.

PMOS-transistors P5 and P6 preferably have long channel lengths, to provide that they both operate in the inversion-operating region.

In FIG. 1 a PMOS-transistor P7 is also included in accordance with the invention. On switch-on of the supply voltage VDD, transistor P7 provides that the generator is started by charging the voltage output terminal to some slight extent. This causes the reference generator to reach the desired stable state.

We claim:

1. A reference generator for generating a reference output current at a current output terminal, comprising a first and a second current mirror and a resistive element, an output chain of the first current mirror being coupled to an input chain of the second current mirror, and an output chain of the second current mirror being coupled to the input chain of the first current mirror, the output chain of the second current mirror being coupled to a first power supply terminal via a resistive element, characterized in that the reference generator also includes a third current mirror, an output chain of which is coupled to the output chain of the first current mirror, an input chain of said third current mirror being connected to a voltage output terminal for supplying a reference output voltage and said current output terminal being coupled to the output chain of said second current mirror.

2. A reference generator as claimed in claim 1, characterized in that the output chain of the third current mirror is arranged between the output chain and input chain of the first and second current mirror, respectively.

3. A reference generator as claimed in claim 1, characterized in that the input chain of the third current mirror includes a resistive load.

4. A reference generator as claimed in claim 3, characterized in that the resistive load is coupled to the resistive element and to the output chain of the first current mirror.

5. A reference generator as claimed in claim 3, characterized in that the resistive load comprises a transistor arranged in the circuit as a diode.

6. A reference generator as claimed in claim 1, characterized in that the resistive element comprises a transistor, a control electrode of which is connected to the voltage output terminal.

7. A reference generator as claimed in claim 6, characterized in that the transistor of the resistive element is a field-effect transistor.

8. A reference generator as claimed in claim 1, characterized in that a transistor which is arranged in the circuit as a diode is included between the voltage output terminal and a second supply terminal.

* * * * *